US007997178B2

(12) United States Patent
Gustavsson et al.

(10) Patent No.: US 7,997,178 B2
(45) Date of Patent: Aug. 16, 2011

(54) METHOD FOR PRODUCING PROPELLANT CHARGES FROM A GRANULATED PROPELLANT, PREFERABLY GRANULATED POWDER, AND PROPELLANT CHARGES PRODUCED IN ACCORDANCE WITH THE AFOREMENTIONED METHOD

(75) Inventors: Lennart Gustavsson, Karlskoga (SE); Lars-Erik Bjorn, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 549 days.

(21) Appl. No.: 12/089,837

(22) PCT Filed: Oct. 6, 2006

(86) PCT No.: PCT/SE2006/001134

§ 371 (c)(1), (2), (4) Date: Aug. 14, 2008

(87) PCT Pub. No.: WO2007/043942

PCT Pub. Date: Apr. 19, 2007

(65) Prior Publication Data

US 2009/0308234 A1 Dec. 17, 2009

(30) Foreign Application Priority Data

Oct. 11, 2005 (SE) ..... 0502239

(51) Int. Cl.
*F42B 33/02* (2006.01)
*F42B 5/38* (2006.01)

(52) U.S. Cl. ..... 86/23; 102/282; 86/31

(58) Field of Classification Search ..... 86/23; 102/288–292; 149/109.6
See application file for complete search history.

(56) References Cited

U.S. PATENT DOCUMENTS

| | | | | |
|---|---|---|---|---|
| 2,072,671 | A * | 3/1937 | Foulke | 102/448 |
| 4,688,465 | A * | 8/1987 | Melhus et al. | 86/20.14 |
| 5,218,166 | A * | 6/1993 | Schumacher | 102/431 |
| 5,269,244 | A * | 12/1993 | Cataletto | 112/302 |
| 5,335,599 | A | 8/1994 | Thiesen et al. | |
| 6,305,288 | B1 * | 10/2001 | Nilsson et al. | 102/288 |
| 6,877,415 | B2 * | 4/2005 | Griesbach et al. | 89/34 |
| 7,370,565 | B2 * | 5/2008 | Pressley et al. | 86/31 |
| 2005/0183611 | A1 * | 8/2005 | White et al. | 102/282 |

FOREIGN PATENT DOCUMENTS

| | | |
|---|---|---|
| GB | 1439450 | 6/1976 |
| SE | 441473 | 10/1985 |

* cited by examiner

*Primary Examiner* — Bret Hayes
*Assistant Examiner* — Joshua Freeman
(74) *Attorney, Agent, or Firm* — Connolly Bove Lodge & Hutz LLP

(57) ABSTRACT

The present invention proposes a novel method for producing powder charges with a high charge density consisting of a granulated powder lying loosely in the charge. In accordance with the invention, the powder is vacuum-packed in airtight pouches made of a combustible and preferably flexible packaging material.

20 Claims, No Drawings

METHOD FOR PRODUCING PROPELLANT CHARGES FROM A GRANULATED PROPELLANT, PREFERABLY GRANULATED POWDER, AND PROPELLANT CHARGES PRODUCED IN ACCORDANCE WITH THE AFOREMENTIONED METHOD

RELATED APPLICATIONS

This application is a national stage application (under 35 U.S.C.§371) of PCT/SE2006/001134 filed Oct. 6, 2006, which claims benefit of Swedish application 0502239-7 filed Oct. 11, 2005, disclosure of which is incorporated herein by reference.

TECHNICAL FIELD

The present invention relates to a method for producing propellant charges with a high charge density consisting of a granulated propellant lying loosely in the propellant charge and to propellant charges produced in accordance with the aforementioned method, and primarily propellant charges for barrel weapons.

PRESENTATION OF THE PROBLEM AND PREVIOUSLY DISCLOSED METHOD

Efforts have been made more or less constantly in the area of artillery technology to increase the range and armour penetration capability of existing and newly designed artillery pieces, which in both cases means that the muzzle velocities of the projectiles concerned must be increased. As a rule, with regard to increasing the muzzle velocity from older barrel weapons, for example artillery pieces, there has been the advantage that even these older, yet fully functional, barrel weapons would be capable, purely from the point of view of their strength, of withstanding larger propellant charges than the charges for which the aforementioned barrel weapons were originally intended. The solution to the problems of giving the ammunition for such weapons a longer range and better penetration would then be to increase the energy content of the propellant charges by increasing the weight of the charge, that is to say by packing even more explosive substance into the existing charging space of the ammunition in question or the weapon so that the charging density increases, although the problem that often presents itself then is that the charging spaces present in the respective artillery pieces or ammunition cases have already been utilized optimally having regard for the available types of propellant.

The most common type of propellant charges for artillery pieces and anti-aircraft guns consists of granulated powder, very frequently of the hollow type. Propellant charges consisting of a granulated propellant will always contain numbers of empty spaces of different sizes between the granules, however, depending on the form and size of the granules. This means that optimal use is not made of the charge space.

Attempts have accordingly been made for some time to reduce the combined volume of empty spaces within the propellant charges, among other things by mixing a propellant charge with different sizes of granulate, with the intention that more fine-grained propellant components will fill the empty spaces between more coarse-grained propellant components. It is also known that the charge density, in particular in the case of cartridge ammunition charged with a granulated propellant, can be increased to a certain degree by compacting the propellant inside the cartridge case intended for the propellant charge, although at the same time this means that the granules will be deformed to a greater or lesser degree, depending on the degree of compaction, which in turn has a negative effect on the characteristics of the propellant.

PURPOSE OF THE INVENTION AND DISTINCTIVE FEATURES

In accordance with the present invention, it is now proposed, instead of active mechanical compaction, to increase the charging density of the granulated propellant charges by vacuum-packing the propellant by vacuum suction in an airtight and moisture-tight and preferably combustible and flexible material, for example in the form of pouches of some form of plastic, metal or rubber, for example polyethylene film, aluminium foil, etc. It will be appreciated that the packaging material can consist of one or more layers of one or more different materials. The principal consideration is to ensure that the finished pack is sufficiently airtight to permit the granules inside the pack to be packed together by the applied vacuum, and that this vacuum is capable of being maintained during the necessary period of use of the propellant charge.

An improved method of producing propellant charges with a high charge density consisting of a granulated propellant lying loosely in the propellant charge has thus been achieved according to the present invention, which improved method of production is characterized in that a quantity of granulated propellant contained in the propellant charge is vacuum-packed in an airtight packaging material.

According to other aspects of the method in accordance with the invention, it is true:

- that the granulated propellant is vacuum-packed in combustible pouches of packaging material;
- that the granulated propellant is vacuum-packed in flexible pouches consisting of plastic that is welded together in an airtight fashion;
- that the granulated propellant is vacuum-packed in pouches consisting of metal foil;
- that the propellant is vacuum-packed in pouches made of a material of which the inside and/or outside has been coated with a wear protection substance and/or decoppering material;
- that the vacuum-packing of the propellant is performed directly into an ammunition case for which the propellant is intended.
- that the vacuum-pack or the vacuum-packs of the propellant is/are formed in such a way that a desired space is obtained around the propellant charge inside the case and/or against other ammunition components present inside the ammunition case.

The propellant charge according to the invention is characterized in that it comprises a quantity of granulated propellant in accordance with the method vacuum-packed in a pouch made of a material adapted for vacuum-packing.

ADVANTAGES AND EFFECTS OF THE INVENTION

The technique of vacuum-packing different materials in powder form, and in particular foodstuffs, in order for these to be packed in an aroma-tight fashion is by no means novel, although as far as we are aware it has never previously been proposed in the context of propellant charges, and even if an advantage can obviously be derived from the propellant being packed in an airtight and moisture-tight fashion in this way, the gentle compacting of the granules is the most sought-after feature in the context of propellants.

The actual vacuum-packing of the propellant can be performed in principle with existing equipment in the form of vacuum pumps and plastic welding machines, even if it is necessary, of course, to take the safety aspects into consideration having regard for the ease of ignition of the propellant.

Practical testing has revealed that it is very easy, with currently available equipment in the form of a relatively simple vacuum pump and plastic welding machine, to achieve an increase in the order of 5% in the weight of the charge for a particular quality of propellant, which, under otherwise unchanged circumstances, would provide an increase in the order of 2% in the muzzle velocity of, for example, a 40 mm armour-piercing projectile, which in turn would theoretically mean an increase in the order of 3% in the armour penetration capability.

The improvement achieved in accordance with the invention can be considered as being marginal, although in view of the continuing competition between defence and countermeasures, any improvement can be quite valuable, especially since the improvement proposed here can be achieved by very simple means. The charging density, that is to say the granulate density of the propellant, can very probably be increased further with a more powerful vacuum pump, and with it also the weight of the charge.

The invention is also associated with the advantage that the propellant could already be pre-packed by the manufacturer.

A further advantage associated with the invention is that it would be possible, with a propellant vacuum-packed in suitable pouches, to form a desired space around the charge inside the case and/or against other ammunition components present inside the ammunition case, such as the fuse, the projectile part, etc., and thereby to improve the propagation of the propellant.

Alternative Embodiments

In conclusion, it can also be pointed out that the pouches utilized for the vacuum-packing of the explosive substance could, if necessary, be coated internally and/or externally with conventional wear protection substances and decoppering materials.

It will be appreciated that the invention can be utilized for all types of charges, in which an explosive substance in the form of a powder or granulate, that is to say a more or less finely distributed propellant, is utilized for the propulsion of projectiles through some form of barrel weapon, for example for artillery ammunition, anti-aircraft ammunition, trench mortar ammunition, etc.

The propellant and the propellant charge that are described above usually consist of granulates of some form of powder or powder charge, although it will be appreciated that the invention covers all explosive substances and all propellant charges which contain smaller units that require to be packed together into a certain volume, where a part of that volume consists of an empty space between the constituent units that is capable of compaction.

It will also be appreciated that the expression combustible material used above here also covers the rather broader meaning of the decomposition that takes place in conjunction with the explosive combustion of the propellant if the packaging material consists of a metal package.

The invention has been defined in the following patent Claims.

The invention claimed is:

1. Method for producing propellant charges consisting of granulated propellant particles lying loosely with respect to each other in the propellant charge, which comprises vacuum packing a quantity of granulated propellant contained in the propellant charge in an airtight packaging material thereby increasing its charge density.

2. Method for producing propellant charges according to claim 1, which comprises vacuum packing the granulated propellant in combustible pouches of packaging material.

3. Method for producing propellant charges according to claim 2, which comprises vacuum packing the granulated propellant in flexible pouches consisting of plastic that is welded together in an airtight fashion.

4. Method for producing propellant charges according to claim 2, which comprises vacuum packing the granulated propellant in pouches consisting of metal foil.

5. Method for producing propellant charges according to claim 2, which comprises vacuum packing the propellant directly into an ammunition case for which the propellant is intended.

6. Method for producing propellant charges according to claim 2, which comprises forming one or more vacuum-packs of the propellant in such a way that a desired space is obtained around the propellant charge inside an ammunition case and/or against other ammunition components present inside the ammunition case.

7. Method for producing propellant charges according to claim 1, which comprises vacuum packing the granulated propellant in flexible pouches consisting of plastic that is welded together in an airtight fashion.

8. Method for producing propellant charges according to claim 7, which comprises vacuum packing the granulated propellant in pouches consisting of metal foil.

9. Method for producing propellant charges according to claim 7, which comprises vacuum packing the propellant in pouches made of a material of which the inside and/or outside has been coated with a wear protection substance and/or decoppering material.

10. Method for producing propellant charges according to claim 7, which comprises vacuum packing the propellant directly into an ammunition case for which the propellant is intended.

11. Method for producing propellant charges according to claim 7, which comprises forming one or more vacuum-packs of the propellant in such a way that a desired space is obtained around the propellant charge inside an ammunition case and/or against other ammunition components present inside the ammunition case.

12. Method for producing propellant charges according to claim 1, which comprises vacuum packing the granulated propellant in pouches consisting of metal foil.

13. Method for producing propellant charges according to claim 12, which comprises vacuum packing the propellant in pouches made of a material of which the inside and/or outside has been coated with a wear protection substance and/or decoppering material.

14. Method for producing propellant charges according to claim 12, which comprises vacuum packing the propellant directly into an ammunition case for which the propellant is intended.

15. Method for producing propellant charges according to claim 1, which comprises vacuum packing the propellant in pouches made of a material of which the inside and/or outside has been coated with a wear protection substance and/or decoppering material.

16. Method for producing propellant charges according to claim 15, which comprises vacuum packing the propellant directly into an ammunition case for which the propellant is intended.

17. Method for producing propellant charges according to claim 1, which comprises vacuum packing the propellant directly into an ammunition case for which the propellant is intended.

18. Method for producing propellant charges according to claim 1, which comprises forming one or more vacuum-packs of the propellant in such a way that a desired space is obtained around the propellant charge inside an ammunition case and/or against other ammunition components present inside the ammunition case.

19. Propellant charge, characterized in that it comprises a quantity of granulated propellant in accordance with the method according to claim 1 vacuum-packed in a pouch made of a material capable of vacuum-packing.

20. Method for producing propellant charges according to claim 2, which comprises vacuum packing the propellant in pouches made of a material of which the inside and/or outside has been coated with a wear protection substance and/or decoppering material.

* * * * *